United States Patent [19]

Doherty

[11] 4,285,359

[45] Aug. 25, 1981

[54] INTERFACE UNIT FOR VACUUM SEWERS

[75] Inventor: Ian Doherty, Richmond, Canada

[73] Assignee: Aktiebolaget Electrolux, Stockholm, Sweden

[21] Appl. No.: 62,653

[22] Filed: Aug. 1, 1979

[51] Int. Cl.[3] ..... E03D 1/00

[52] U.S. Cl. ..... 137/205; 137/236 R; 137/396; 4/380

[58] Field of Search ..... 137/205, 236 R, 403, 137/396, 363, 364; 4/316, 300, 380

[56] References Cited

U.S. PATENT DOCUMENTS

| | | | |
|---|---|---|---|
| 3,807,431 | 4/1974 | Swanteson | 137/205 |
| 3,998,736 | 12/1976 | Greenleaf | 137/396 X |
| 4,120,312 | 10/1978 | Michael | 137/205 X |

*Primary Examiner*—Alan Cohan

*Attorney, Agent, or Firm*—Townsend and Townsend

[57] ABSTRACT

An interface unit connects an accumulation enclosure for a gravity feed conduit to a vacuum sewage conduit. The unit has an enclosure extension extending upwardly and having a top end near ground level. A vacuum conduit extension extends downwardly within the enclosure extension and has a bottom end near the accumulation enclosure.

18 Claims, 2 Drawing Figures

INTERFACE UNIT FOR VACUUM SEWERS

BACKGROUND OF THE INVENTION

This invention relates to an interface unit for vacuum sewage systems.

Vacuum sewage systems are used to replace conventional gravity sewers in areas having such problems as hilly or rocky terrain, low population density, adverse grade conditions, high water table or flat land. Where such problems exist, vacuum sewage systems are often a very attractive, economical alternative to conventional systems.

Conventional plumbing fixtures can be used within the dwelling, or other source of sewage, and a conventional gravity line leads therefrom. At each source of sewage, an interface unit is used to connect the conventional plumbing to the vacuum sewage system. From this point, the sewage is propelled through the vacuum main to a central collecting station, located, typically, up to a mile away from the interface unit. From the collecting station, the sewage is discharged, for example, to a gravity sewer, force main, treatment plant or lagoon.

At the end of the gravity pipe leading from each building or group of buildings, an accumulation enclosure is used to batch a volume of liquid for admission into the vacuum system. The accumulation enclosure may simply be a horizontal extension of the gravity fed pipe at a slightly lower elevation. Alternatively, a tank or other container may be used for the accumulation enclosure. The vacuum sewage conduit is usually smaller in diameter than the gravity feed pipe and is located closer to ground level.

Conventionally, the interface unit includes a cylindrical chamber which extends downwardly from ground level to the accumulation enclosure. Within the enclosure, a suction tube or vacuum conduit extension extends downwardly from the vacuum conduit to the accumulation enclosure. Where the accumulation enclosure is a pipe having the same diameter as the gravity feed conduit, a reducer coupling connects the accumulation enclosure to the vacuum conduit extension. There is a vacuum-activated valve on the vacuum conduit. The valve is normally closed, but is opened when a sensor unit, connected to the accumulation enclosure, senses a predetermined hydrostatic pressure. Consequently, when a batch of sewage has accumulated in the accumulation enclosure, the sensor unit causes the valve to open and allows the batch of sewage to flow upwardly through the vacuum conduit extension to the vacuum conduit and the vacuum sewage system. The valve is closed at the end of a timed cycle or upon a drop of hydrostatic pressure within the accumulation enclosure to a specified level.

In the conventional interface unit described above, blockage is most likely to occur at the reducer coupling between the accumulation enclosure and the bottom of the vacuum conduit extension. A cleanout plug is normally provided adjacent the reducer in case a blockage should occur. To give access to this cleanout plug, the chamber enclosing the interface unit is desirably extended downwardly to the level of the accumulation enclosure and the cleanout plug.

To reduce the cost of the interface units, one approach has been to shorten the chamber so that it encloses only the end of the vacuum conduit, the valve and the sensor. However, this means that, should a blockage occur at the reducer coupling, the soil above the reducer must be excavated at a considerable cost and inconvenience. Additionally, with this arrangement, there must be a separate conduit from the sensor unit to the accumulator enclosure.

The depth of the interface chamber, and, consequently, the cost of the interface unit, could both be reduced if the reducer coupling could be raised to the level of the end of the vacuum conduit by increasing the size of the vacuum conduit extension to that of the gravity feed conduit and the accumulation enclosure. However, where this has been attempted, the surge of sewage through this relatively large diameter section of pipe to the valve causes unacceptable hammering against the valve or the restriction in the pipe.

For the reasons given above, it would be desirable to have an interface unit which would require only a relatively short chamber at ground level to enclose the valve and sensor unit, but would give access to the point of restriction between the accumulation enclosure and the smaller diameter vacuum conduit extension. At the same time, it would be desirable to eliminate the need for a separate downwardly extending conduit from the sensor to the accumulation enclosure.

SUMMARY OF THE INVENTION

According to the invention, there is provided an interface unit for connecting an accumulation enclosure for a gravity feed conduit to a vacuum sewage conduit. The unit comprises an enclosure extension extending upwardly, and having a top end near ground level, when connected to the accumulation enclosure. A vacuum conduit extension extends downwardly within the enclosure extension, and has a bottom end near the accumulation enclosure, when connected to the vacuum conduit.

When compared with earlier devices, the present invention provides an interface unit for vacuum sewage systems which can have a chamber or container for the valve and sensor unit which need not extend downwardly to the level of the accumulation enclosure to provide access to the point of restriction between the accumulation enclosure and the vacuum conduit. Access to the point of restriction can be achieved without any excavation. The vacuum conduit extension can be the same diameter as the vacuum conduit and, consequently, there is no hammering of liquid against the valve. Additionally, the sensor connection can be within the chamber without requiring a separate conduit down to the accumulation enclosure.

In drawings which illustrate embodiments of the invention:

FIG. 1 is a side elevational view of a vacuum sewage system including an interface unit according to an embodiment of the invention; and FIG. 2 is a side elevational view, partly broken away, of the interface unit of FIG. 1.

DESCRIPTION OF THE PREFERRED EMBODIMENTS

Figure 1:
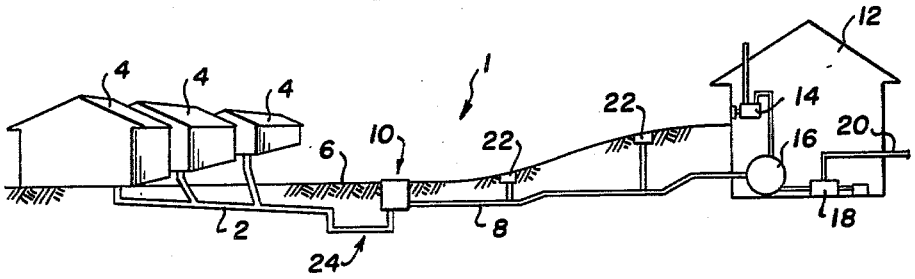

FIG. 1 illustrates a vacuum sewage system 1 including a gravity feed line or pipe 2 originating within a plurality of dwellings 4. The gravity feed pipe 2 is below ground level 6 and is connected to the vacuum sewage conduit or pipe 8, also below the ground level 6, by means of the interface unit 10. As seen, the gravity feed pipe 2 is larger in diameter than the vacuum sewage pipe 8. The vacuum sewage pipe 8 extends to the collection station 12 which includes a vacuum pump 14, a vacuum holding tank 16, a discharge pump 18 and a sewage discharge 20. A plurality of inspection points 22 extend upwardly from the vacuum sewage pipe 8 to the ground level 6.

Figure 2:
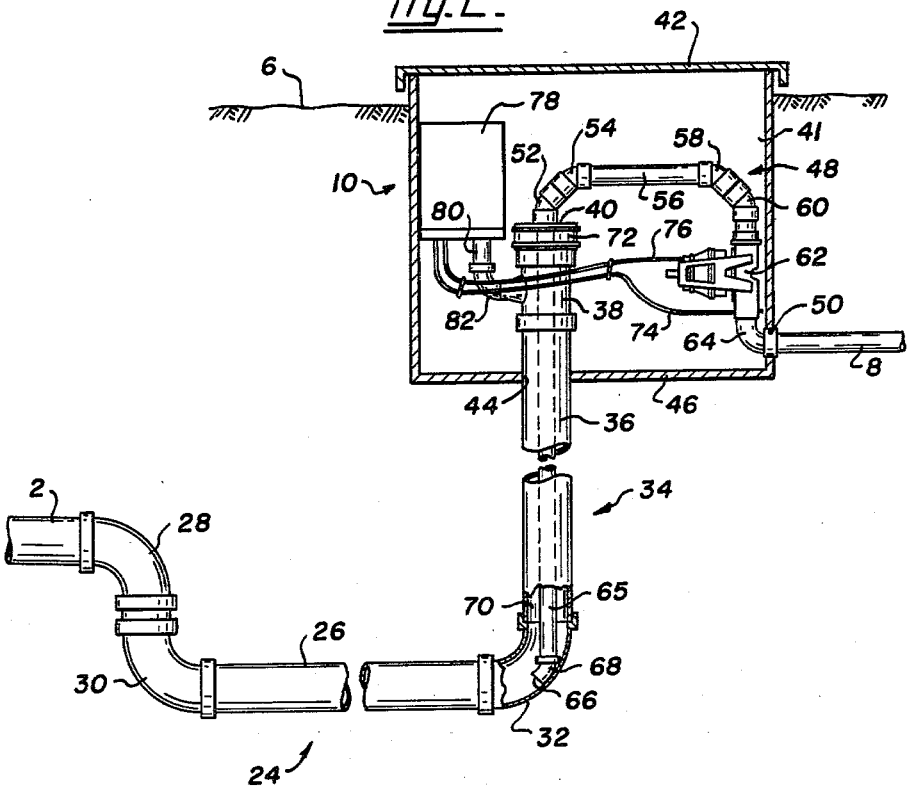

With the exception of the interface unit 10, shown in better detail in FIG. 2, the vacuum sewage system 1 is conventional. At the end of the gravity feed pipe 2 adjacent interface unit 10, an accumulation enclosure 24 is used to accumulate a batch of sewage. The specific accumulation enclosure 24 shown in FIGS. 1 and 2 comprises a horizontal section of sewage pipe 26, having a diameter equal to the diameter of gravity feed pipe 2 and located at a lower elevation relative to ground level 6. Accumulator enclosure 24 also includes downwardly extending elbows 28 and 30 connecting the pipe 26 to the pipe 2 and an upwardly extending elbow 32 below the interface unit 10. While the illustrated accumulation enclosure 24 comprises this U-shaped section of piping, it should be understood that the accumulation enclosure could comprise a tank or some other container.

The interface unit 10 has an enclosure extension 34 which includes a vertical section of sewer pipe 36 connected to elbow 32 of accumulation enclosure 24 and extending vertically upwards towards ground level 6. Pipe 36 has the same diameter as gravity feed pipe 2 and, in this case, the same diameter as pipe 26 of accumulation enclosure 24. In any case, the diameter of pipe 26 should be as great as gravity feed pipe 36 to allow the largest object passable through the gravity feed pipe to be withdrawn from the accumulator enclosure. The enclosure extension 34 has a tee fitting 38 near its top end 40 which is connected to the top of pipe 36.

The top end 40 of enclosure extension 34 is within an interface unit chamber 41 which, in this case, is cylindrical and has a circular top 42 accessible from above ground level 6. Pipe 36 extends upwardly through aperture 44 in the bottom 46 of chamber 41 and suitable sealing is provided at this point.

Vacuum pipe 8 is connected to the vacuum conduit extension 48 adjacent the side of chamber 41. In the preferred embodiment vacuum conduit extension 48 enters chamber 41 through the aperture 50 and sealing is provided around the aperture. Vacuum conduit extension 48 comprises sewer pipe and fittings with an internal diameter the same as vacuum pipe 8. The extension 48 comprises a vertical loop with two 45° elbows 52 and 54 extending upwardly from the top 40 of enclosure extension 34 and connected to a horizontal section of pipe 56. The pipe 56 is connected to a pair of 45° elbows 58 and 60 curving downwardly and connected to vacuum activated valve 62. A 90° elbow 64 connects valve 62 to the vacuum pipe 8. From elbow 52, vacuum conduit extension 48 comprises a pipe 65 with the same internal diameter as vacuum pipe 8. Pipe 65 extends downwardly through enclosure extension 34 to its bottom end 66 which is on the elbow 68 within elbow 32 of accumulation enclosure 24. Since the external diameter of pipe 65 is less than the internal diameter of pipe 36, an annular space 70 communicates downwardly with accumulation enclosure 24 and extends upwardly to the top end 40 of the enclosure extension 34.

The interface unit 10 includes means for sealing the top end 40 of the enclosure extension 34 about vacuum conduit extension 48. In the preferred embodiment, a reducer coupling 72 releasably connects the vacuum conduit extension 48 to the enclosure extension 34 near the top 40 thereof.

Referring again to valve 62, this is a normally closed, vacuum activated valve of the diaphram type. A pair of vacuum lines 74 and 76 operatively connect valve 62 to a sensor unit 78. A pipe 80 and an elbow 82 connect the sensor to the tee 38 of enclosure extension 34. Sensor 78 and valve 62 are otherwise conventional, so they are not described in further detail.

In the preferred form of the invention shown in the drawings, the gravity feed pipe 2, the accumulation enclosure 24 and the enclosure extension 34 all comprise PVC sewer pipes and fittings with the same internal diameter or cross-sectional extent. Similarly, vacuum pipe 8 and vacuum conduit extension 48 both comprise standard PVC sewer pipes and fittings having the same internal diameter or cross-sectional extent, which is significantly smaller than that of pipe 2, enclosure 24 and extension 34. Typically, the vacuum pipe 8 is a 2" pipe, while gravity feed pipe 2 is a 4" pipe.

In use, the sewage from dwellings 4 flows by gravity downwardly into accumulation enclosure 24. Since coupling 72 seals the top 40 of enclosure extension 34 against vacuum conduit extension 48 and valve 62 is normally closed, the buildup of liquid in enclosure 24 causes a corresponding increase in the pressure of the air or other fluid within space 70 of enclosure extension 34. This pressure is communicated to sensor 78 through tee 38, elbow 82 and pipe 80. Sensor 78 is adjusted to apply a vacuum to valve 62 through vacuum lines 74 and 76 to open the valve once a predetermined pressure is reached. In this way, valve 62 only opens when a suitable batch of sewage is accumulated within enclosure 24. Valve 62 remains open until sensor 78 senses the required pressure drop or, alternatively, until the end of a set time. After closing, the sewage may begin to collect again.

As mentioned above, the point where an interface unit is most likely to become blocked is at the point of restriction between the relatively large gravity feed pipe and the smaller vacuum pipe. In the embodiment of the invention shown in the drawings, this point of restriction occurs at end 66 of vacuum conduit extension 48 which is within enclosure 24. However, should a blockage occur at this point, access to the point of blockage can be achieved simply by disconnecting reducer coupling 72 and lifting pipe 65 of vacuum conduit extension 48 upwardly through cover 42 of chamber 41. In essence, the invention makes the point of restriction movable. As a result, it is not necessary to extend to unit enclosure downwardly to accumulation enclosure 24 to give access to the point of restriction. This considerably reduces the cost of the chamber 41. Nor is it necessary to excavate to have access to the point of restriction.

Another advantage of the present invention is the direct connection of sensor 78 to enclosure extension 34 by means of the short pipe 80, elbow 82 and tee 38. There is no need to extend pipe 80 downwardly to enclosure 24 as with some prior art devices. Moreover, there is no hammering of fluid against valve 62 since the point of restriction is adjacent accumulation enclosure 24 instead of being near the valve.

It should be understood that the invention is not limited to specific features of the preferred embodiment described above. For example, other types of pipes or conduits, besides the sewage pipes mentioned above, may be used. It is also possible to install the interface unit below the level of surfaces other than the ground, for example, below a basement floor. The valve 62 would be located in the position of the horizontal section of pipe 56 instead of the position shown in the drawings. The vacuum sewage pipe 8 could be at the level of pipe 56, in which case, there is no need for the downwardly extending portion of vacuum conduit extension 48 between pipe 56 and pipe 8. It is also possible for elbow 64 to extend through the bottom 46 of chamber 41 instead of the side as shown. These are only examples of possible variations.

What I claim is:

1. An interface unit for connecting an accumulation enclosure of a gravity feed conduit to a vacuum conduit comprising: means adapted to be placed adjacent to a surface level for defining a hollow chamber; an enclosure extension extending downwardly from said chamber defining means and having an upper end in the chamber and a lower end spaced below the chamber, the lower end of the enclosure extension adapted to be coupled to said accumulation enclosure in fluid communication therewith, the upper end of the enclosure extension being closed, whereby fluid pressure in the enclosure extension will increase as material is directed into the accumulation enclosure when the extension is coupled thereto; a vacuum conduit extension extending downwardly through the enclosure extension and having a lower open end near the lower end of the enclosure extension, the upper end of the vacuum conduit extension projecting outwardly from the enclosure extension; and means responsive to the fluid pressure in the enclosure extension for coupling the vacuum conduit extension with the vacuum conduit.

2. An interface unit as set forth in claim 1, wherein the vacuum conduit extension is removably coupled to the enclosure extension.

3. An interface unit as set forth in claim 1, wherein said enclosure extension has a removable closure on the upper end thereof, said vacuum conduit extension extending through said closure and being sealed with respect thereto.

4. An interface unit as set forth in claim 3, wherein said chamber defining means has an access opening, said closure on the enclosure extension being accessible through the access opening.

5. An interface unit as set forth in claim 1, wherein the transverse dimension of the vacuum conduit extension is less than that of the enclosure extension to provide a space within the enclosure extension and surrounding the vacuum conduit extension.

6. An interface unit as set forth in claim 1, wherein the coupling means is in the chamber.

7. An interface unit as set forth in claim 1, wherein said accumulation enclosure includes a generally horizontal sewage pipe having a pair of opposed ends, said enclosure extension having means on the lower end thereof for connecting the enclosure extension to one end of the sewage pipe.

8. An interface unit as set forth in claim 1, wherein said coupling means includes an actuatable valve.

9. In an interface unit for connecting an accumulation enclosure of a gravity feed conduit to a vacuum conduit: means adapted to be placed adjacent to a surface level for defining a hollow chamber; an enclosure extension extending downwardly from said chamber defining means and having a closed, upper end in the chamber and an open, lower end spaced below the chamber, the lower end of the enclosure extension adapted to be coupled to said accumulation enclosure in fluid communication therewith; and a vacuum conduit extension extending downwardly through the enclosure extension and having an upper part removably coupled to and projecting outwardly from the enclosure extension, said vacuum conduit extension having a lower open end near the lower end of the enclosure extension, the upper part of the vacuum conduit extension adapted to be coupled to the vacuum conduit.

10. An interface unit as set forth in claim 9, wherein said enclosure extension has a removable closure on the upper end thereof, said vacuum conduit extension extending through said closure and being sealed with respect thereto.

11. An interface unit as set forth in claim 10, wherein said chamber defining means has an access opening, said closure on the enclosure extension being accessible through the access opening.

12. An interface unit as set forth in claim 9, wherein the transverse dimension of the vacuum conduit extension is less than that of the enclosure extension to provide a space within the enclosure extension and surrounding the vacuum conduit extension.

13. In a sewage disposal system: an accumulation enclosure for receiving sewage; a vacuum conduit spaced from the accumulation enclosure; means defining a hollow chamber at a location spaced above the accumulation enclosure; an enclosure extension extending downwardly from said chamber defining means and having an upper end in the chamber, the lower end of the enclosure extension being coupled to said accumulation enclosure in fluid communication therewith, the upper end of the enclosure extension being closed, whereby fluid pressure in the enclosure extension will increase as sewage is directed into the accumulation enclosure; a vacuum conduit extension removably coupled to the enclosure extension and extending downwardly through the enclosure extension, said vacuum conduit extension having a lower open end near the accumulation enclosure and an upper part projecting outwardly from the accumulation enclosure; and means responsive to the fluid pressure in the enclosure extension for placing the upper part of the vacuum conduit extension in fluid communication with the vacuum conduit.

14. In a sewage disposal system as set forth in claim 13, wherein said enclosure extension has a removable closure on the upper end thereof, said vacuum conduit extension extending through said closure and being sealed with respect thereto.

15. An interface unit as set forth in claim 14, wherein said chamber defining means has an access opening, said closure on the enclosure extension being accessible through the access opening.

16. An interface unit as set forth in claim 13, wherein the transverse dimension of the vacuum conduit extension is less than that of the enclosure extension to provide a space within the enclosure extension and surrounding the vacuum conduit extension.

17. An interface unit as set forth in claim 13, wherein said coupling means comprises a valve responsive to the fluid pressure in said enclosure extension.

18. An interface unit as set forth in claim 17, wherein the valve is in the chamber.

* * * * *